US010617184B2

(12) United States Patent
Ma et al.

(10) Patent No.: US 10,617,184 B2
(45) Date of Patent: Apr. 14, 2020

(54) UMBRELLA AND METHOD FOR CONTROLLING THE SAME

(71) Applicant: BOE Technology Group Co., Ltd., Beijing (CN)

(72) Inventors: Xitong Ma, Beijing (CN); Tianyue Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/123,198

(22) Filed: Sep. 6, 2018

(65) Prior Publication Data

US 2019/0281934 A1 Sep. 19, 2019

(30) Foreign Application Priority Data

Mar. 16, 2018 (CN) ..... 2018 1 0217902

(51) Int. Cl.
*A45B 25/00* (2006.01)
*A45B 17/00* (2006.01)
*A45B 19/04* (2006.01)

(52) U.S. Cl.
CPC ..... *A45B 25/00* (2013.01); *A45B 17/00* (2013.01); *A45B 19/04* (2013.01); *A45B 2200/1009* (2013.01)

(58) Field of Classification Search
None
See application file for complete search history.

(56) References Cited

U.S. PATENT DOCUMENTS

2016/0338457 A1* 11/2016 Gharabegian ..... G05B 15/02
2017/0071300 A1* 3/2017 Gharabegian ..... G05B 15/02
2017/0086545 A1* 3/2017 Gharabegian ..... G05B 15/02
2017/0086546 A1* 3/2017 Gharabegian ..... G05B 15/02
2017/0332750 A1* 11/2017 Gharabegian ..... H04N 7/181

FOREIGN PATENT DOCUMENTS

CN 103445419 A 12/2013
CN 205358542 U 7/2016
CN 206079358 U 4/2017
CN 107411270 A 12/2017
CN 107455871 A 12/2017
CN 206687312 U 12/2017

OTHER PUBLICATIONS

Office Action issued in corresponding Chinese Patent Application No. 201810217902.9, dated Apr. 28, 2019.

* cited by examiner

*Primary Examiner* — Noah Chandler Hawk
(74) *Attorney, Agent, or Firm* — McDermott Will & Emery LLP

(57) ABSTRACT

An umbrella and a method for controlling the same are provided. The umbrella includes a canopy; a support assembly configured to support the canopy; a driving mechanism configured to drive the support assembly; a photographing assembly configured to take a photograph of user's head(s) and output the photograph of user's head(s); and a control assembly configured to acquire a user information according to outputted photograph of user's head(s), and to process the user information to generate an adjustment signal, and to control the driving mechanism according to the adjustment signal, so as to adjust a coverage of the canopy.

15 Claims, 3 Drawing Sheets

UMBRELLA AND METHOD FOR CONTROLLING THE SAME

CROSS-REFERENCE TO RELATED APPLICATION

This application claims the benefit of Chinese Patent Application No. 201810217902.9 filed on Mar. 16, 2018 in the State Intellectual Property Office of China, the whole disclosure of which is incorporated herein by reference.

BACKGROUND OF THE INVENTION

Field of the Invention

The present disclosure relates to a field of daily necessities, and in particular to an umbrella and a method for controlling the umbrella.

Description of the Related Art

For an umbrella of the related art, its position is typically adjusted by the user based on sensation. Therefore, it is difficult to accurately support the umbrella right over a center of the user's head(s), which adversely affects the rain-proof effect of the umbrella.

SUMMARY OF THE INVENTION

According to an aspect of the present disclosure, there is provided an umbrella, comprising:

a canopy;

a support assembly configured to support the canopy;

a driving mechanism configured to drive the support assembly;

a photographing assembly configured to take a photograph of user's head(s) and output the photograph of user's head(s); and a control assembly configured to acquire a user information according to outputted photograph of user's head(s), and to process the user information to generate an adjustment signal, and to control the driving mechanism according to the adjustment signal, so as to adjust a coverage of the canopy.

In an embodiment, the user information comprises number of the user and position(s) of the user, wherein the user comprises a single person, and the control assembly is configured to generate a position adjustment signal according to a distance between the position of the user and a center position of the canopy, and control the driving mechanism to drive the support assembly according to the position adjustment signal, such that the position of the user is within the coverage of the canopy.

In an embodiment, the user information comprises number of the user and position(s) of the user, wherein the user comprises a plurality of persons, and the control assembly is configured to generate a position adjustment signal according to distances each between the position of each of persons of the user and a center position of the canopy, and control the driving mechanism to drive the support assembly according to the position adjustment signal, such that a central position of the plurality of persons of the user is within the coverage of the canopy.

In an embodiment, the support assembly comprises:

a hand-held portion;

a first rotating portion connected to the hand-held portion through a first connecting rod;

a second rotating portion connected to the first rotating portion through a telescopic mechanical shaft and connected to the canopy through a second connecting rod;

wherein the driving mechanism adjusts the position of the canopy by driving the first rotating portion and the telescopic mechanical shaft, and performs a first adjustment to the angle of the canopy by driving the second rotating portion.

In an embodiment, the support assembly further comprises a third rotating portion and a third connecting rod, the third rotating portion being connected between the second connecting rod and the third connecting rod, and the third connecting rod being connected between the canopy and the third rotating portion, wherein the driving mechanism is further configured to drive the third rotating portion according to the angle adjustment signal so as to perform a second adjustment to the angle of the canopy.

In an embodiment, the umbrella further comprises a pressure detecting assembly disposed corresponding to the canopy and connected to the control assembly, wherein the pressure detecting assembly is configured to detect force distribution information of the canopy, and the control assembly is configured to generate an angle adjustment signal according to the force distribution information of the canopy and to drive the second rotating portion through the driving mechanism according to the angle adjustment signal.

In an embodiment, the first rotating portion is configured to control the telescopic mechanical shaft to rotate in a plane perpendicular to the first connecting rod, at a rotation angle ranging between 0-360 degrees; the second rotating portion is configured to control the second connecting rod to be deflected with respect to a vertical direction, at a deflection angle ranging between 0-90 degrees; and the third rotating portion is configured to control the third connecting rod to be deflected with respect to the vertical direction, at the deflection angle ranging between 0-20 degrees.

In an embodiment, the first connecting rod and the telescoping mechanical shaft are at an angle of 90 degrees and the telescopic mechanical shaft is extendable and retractable in an axial direction.

In an embodiment, the pressure detecting assembly comprises a plurality of pressure sensors distributed across the canopy.

In an embodiment, the plurality of pressure sensors are distributed in an array.

According to another aspect of the present disclosure, there is provided a method for controlling above umbrella, comprising the steps of:

taking a photograph of user's head(s) with the photographing assembly;

acquiring a user information according to the photograph of user's head(s), and processing the user information to generate an adjustment signal; and controlling the driving mechanism to drive the support assembly according to the adjustment signal, so as to adjust the coverage of the canopy.

In an embodiment, the support assembly comprises a hand-held portion, a first rotating portion and a second rotating portion, the first rotating portion being connected to the hand-held portion through a first connecting rod and the second rotating portion being connected to the first rotating portion through a telescopic mechanical shaft and being connected to the canopy through a second connecting rod, wherein the driving mechanism driving the support assembly, comprising:

the driving mechanism adjusting a position of the canopy by driving the first rotating portion and the telescopic mechanical shaft, and adjusting an angle of the canopy by driving the second rotating portion.

In an embodiment, the method further comprises:

detecting force distribution information of the canopy; and generating an angle adjustment signal according to the force distribution information of the canopy, and driving and controlling the second rotating portion with the driving mechanism according to the angle adjustment signal.

In an embodiment, the support assembly further comprises a third rotating portion and a third connecting rod, the third rotating portion being connected between the second connecting rod and the third connecting rod, and the third connecting rod being connected between the canopy and the third rotating portion, wherein the driving mechanism further drives the third rotating portion according to the angle adjustment signal to adjust the angle of the canopy.

In an embodiment, the first rotating portion is configured to control the telescopic mechanical shaft to rotate in a plane perpendicular to the first connecting rod, at a rotation angle ranging between 0-360 degrees; the second rotating portion is configured to control the second connecting rod to be deflected with respect to a vertical direction, at a deflection angle ranging between 0-90 degrees; and the third rotating portion is configured to control the third connecting rod to be deflected with respect to the vertical direction, at the deflection angle ranging between 0-20 degrees.

In an embodiment, the user information comprises number of the user and the position(s) of the user, wherein in response to the user comprising a single person, a position adjustment signal is generated according to a distance between the position of the user and a center position of the canopy, and the driving mechanism is controlled to drive the support assembly according to the position adjustment signal, such that the position of the user falls within the coverage of the canopy.

In an embodiment, the user information comprises number of the user and the position(s) of the user, wherein in response to the user comprising a plurality of persons, a position adjustment signal is generated according to a distance between the position of each of persons of the user and a center position of the canopy, and the driving mechanism is controlled to drive the support assembly according to the position adjustment signal, such that a central position among the plurality of persons of the user falls within the coverage of the canopy.

DETAILED DESCRIPTION OF PREFERRED EMBODIMENTS

Figure 1:
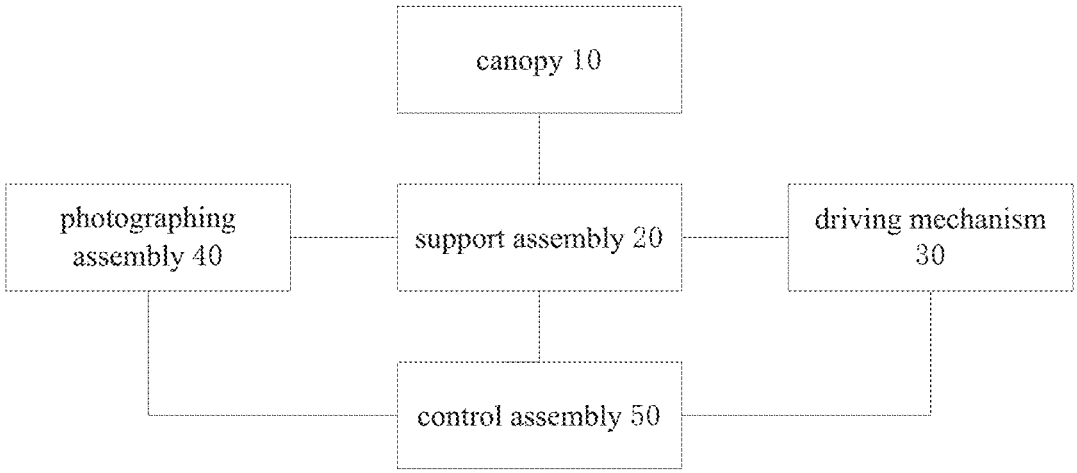
FIG. 1 is a block schematic diagram of an umbrella according to some embodiments of the present disclosure.

The embodiments of the present disclosure are described in detail below, and the examples of the embodiments are illustrated in the drawings, in which the same or similar reference signs are used to refer to the same or similar elements or elements having the same or similar functions. The embodiments described below with reference to the accompanying drawings are intended to be illustrative, and are not to be construed as limiting the present disclosure.

In an embodiment of the present disclosure, a control assembly may include one or more processors, such as a central processing unit (CPU), a field programmable logic array (FPGA), a microcontroller (MCU), and a digital signal processor (DSP), an application specific integrated circuit (ASIC) and a logic operation device having an data processing capability and/or a program execution capability.

It is easy to understand that the control assembly may be programmed to adjust, update or execute functions to be implemented, and the functions to be implemented may be performed with computational instructions. Optionally, the control assembly may also include a memory configured to store the computational instructions, and a processor configured to read and run the computational instructions to perform the functions to be implemented.

Here, the computational instructions include one or more processor operations defined by an instruction set architecture corresponding to the processor, which may be logically included and represented by one or more computer programs.

In an embodiment of the present disclosure, a connection between electrical components (such as the control assembly, a photographing assembly, a driving mechanism) may be a wired connection, such as a cable, a wire, a network cable, and the like; or alternatively, it may be a wireless connection, such as a Wi-Fi, Bluetooth, Zigbee, WWAN, and the like.

In an embodiment of the present disclosure, the photographing assembly may be various imaging devices that may form a photograph of the head(s) of the user, such as a camera based on a CMOS or CCD imaging element, a thermal imaging device based on an infrared imaging device, a microwave-based imaging radar, which may be applied to embodiments of the present disclosure.

In an embodiment of the present disclosure, the driving mechanism may be implemented with various types of actuators, such as hydraulic drive motors, pneumatic motors, electric motors, magnetic drives, piezoelectric actuators, thermoelectric drives, MEMS devices and the like.

A method for controlling an umbrella and an umbrella of an embodiment of the present disclosure will be described below with reference to the drawings.

FIG. 1 is a block schematic diagram of an umbrella according to some embodiments of the present disclosure. As shown in FIG. 1, an umbrella provided in accordance with some embodiments of the present disclosure includes a canopy 10, a support assembly 20, a driving mechanism 30, a photographing assembly 40, and a control assembly 50.

The support assembly 20 is used to support the canopy 10; the driving mechanism 30 is connected to the support assembly 20 and the driving mechanism 30 is used to drive the support assembly 20; the photographing assembly 40 is used to take a photograph of the user's head(s); and the control assembly 50 is connected respectively with the photographing assembly 40 and the driving mechanism 30. The control assembly 40 is configured to acquire user information according to the photograph of the head(s) of the user, to process the user information to generate an adjustment signal, and to control the driving mechanism 30 according to the adjustment signal, so as to adjust coverage of the canopy 10.

For example, the photographing assembly 40 may be disposed on the support assembly 20 to enable the photographing assembly 40 to take a photograph of user's head(s).

In the umbrella provided by an embodiment of the present disclosure, the photographing assembly 40 takes a photograph of user's head(s) and sends it to the control assembly 50. The control assembly 50 acquires user information according to the photograph of the head(s) of the user, such as the number and position of the user; and the control assembly 50 processes the user information to generate an adjustment signal, for example, a distance between the position of the user and a center position of the canopy 10 is thus processed to generate a position adjustment signal, and then the control assembly 50 controls the driving mechanism 30 according to the adjustment signal so as to adjust the coverage of the canopy 10, thereby allowing the umbrella to protect the user to its utmost extent.

Figure 2:
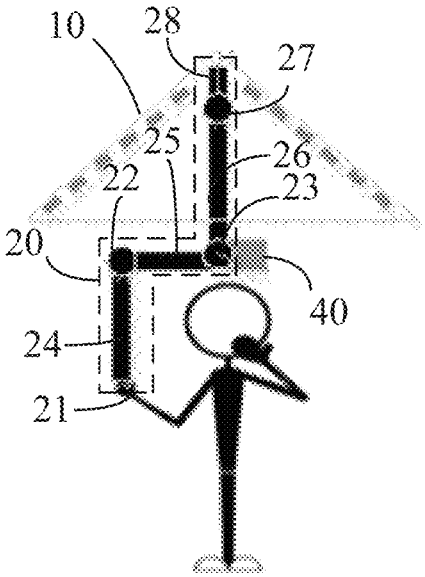
FIG. 2 is a structural schematic diagram of an umbrella according to some embodiments of the present disclosure.

According to some embodiments of the present disclosure, as shown in FIG. 2, the support assembly 20 includes a hand-held portion 21, a first rotating portion 22, and a second rotating portion 23.

The first rotating portion 22 is connected to the hand-held portion 21 through the first connecting rod 24; the second rotating portion 23 is connected to the first rotating portion 22 through a telescopic mechanical shaft 25 and is connected to the canopy 10 through a second connecting rod 26; the driving mechanism 30 adjusts the position of the canopy 10 by driving the first rotating portion 22 and the telescopic mechanical shaft 25, and perform a first adjustment to an angle of the canopy 10 by driving the second rotating portion 23.

In some embodiments, an angle between the first connecting rod 24 and the telescopic mechanical shaft 25 is 90 degrees, and the telescopic mechanical shaft 25 may be axially telescoped.

In some embodiments, the first rotating portion 22 is a spherical hinge capable of implementing a rotation at an angle ranging between 0-360 degrees in a plane perpendicular to the first connecting rod.

In some embodiments, the second rotating portion 23 is a pivoting member for controlling the second connecting rod 26 to be deflected with respect to a vertical direction at a deflection angle ranging between 0-90 degrees.

In some embodiments, the first rotating portion 22 is configured to control the telescopic mechanical shaft 25 to rotate in a plane perpendicular to the first connecting rod at an angle ranging between 0-360 degrees, and the second rotating portion 23 is configured to control the second connecting rods 26 to be deflected with respect to a direction parallel to the first connecting rod 24, that is, as shown in FIG. 2, to be rotated from the vertical direction to the horizontal direction at an angle ranging between 0-90 degrees.

To be taken as an example, the support assembly 20 is connected to the canopy 10 sequentially by the hand-held portion 21, the first connecting rod 24, the first rotating portion 22, the telescopic mechanical shaft 25, the second rotating portion 23, and the second connecting rod 26. The first connecting rod 24 is perpendicular to the telescopic mechanical shaft 25.

In an embodiment of the present disclosure, the telescopic mechanical shaft may be formed by a plurality of inter-sleeved shafts, a hydraulically driven shaft, a shaft with a spring connected at an end thereof, and a motor-driven shaft, and the like.

In the umbrella provided by the embodiment of the present disclosure, the photographing assembly 40 may take a photograph of the head(s) of the user and send it to the control assembly 50. The control assembly 50 generates a position adjustment signal according to the photograph of the head(s) of the user, so that the control assembly 50 may control the control driving mechanism 30 to drive the first rotating portion 22, the second rotating portion 23, and the telescopic mechanical shaft 25 according to the a position adjustment signal. When the user holds the umbrella through the hand-held portion 21, the control assembly 50 drives the first rotating portion 22 to rotate through the driving mechanism 30 according to the position adjustment signal, and the first rotating portion 22 may drive the telescopic mechanical shaft 25, the second rotating portion 23, the second connecting rod 26 and the canopy 10 to rotate in a plane perpendicular to the first connecting rod when the first rotating portion 22 is rotated, so that the canopy 10 may be maintained over the top of the user's head regardless of the left or right hand is used to hold the umbrella. The driving mechanism 30 further drives the telescopic mechanical shaft 25 to be retracted or extended so that the second rotating portion 23 may be maintained over the head of the user. After the positions of the first rotating portion 22 and the telescopic mechanical shaft 25 are determined, the driving mechanism 30 drives the second rotating portion 23 to rotate, and the second rotating portion 23 is rotatable between the vertical direction and the horizontal direction to adapt to the posture of the user. For example, when the user leans forward, the second rotating portion 23 may be rotated with a tilting angle of the user's upper body, so that the umbrella may be maintained over the top of the user's head when the user adopts any posture, thereby protecting the user to its utmost extent.

According to some embodiments of the present disclosure, as shown in FIG. 2, the support assembly 20 further includes a third rotating portion 27 and a third connecting rod 28. The third rotating portion 27 is connected between the second connecting rod 26 and the third connecting rod 28, the third connecting rod 28 connects the canopy 10 and the third rotating portion 27. The driving mechanism 30 further drives the third rotating portion according to the angle adjustment signal to perform a second adjustment to the angle of the canopy.

Figure 4A:
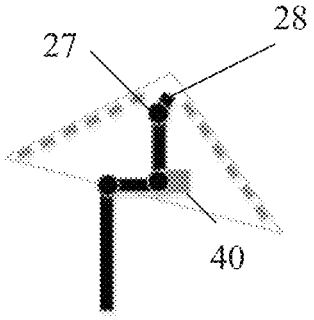
FIG. 4*a* is a structural schematic diagram of an umbrella according to some embodiments of the present disclosure, in which a third rotating portion of the umbrella is rotated 20 degrees to the right.
Figure 4B:
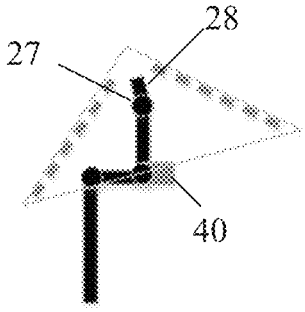
FIG. 4*b* is a structural schematic diagram of an umbrella according to some embodiments of the present disclosure, in which the third rotating portion of the umbrella is rotated 20 degrees to the left.

For example, as shown in FIGS. 4*a* and 4*b*, the third rotating portion 27 is used for controlling the third connecting rod to be deflected with respect to the vertical direction, and the deflection angle ranges between 0-20 degrees.

In the umbrella provided by the embodiment of the present disclosure, one end of the second connecting rod 26 is connected to the second rotating portion 23, the other end of the second connecting rod 26 is connected to the third rotating portion 27. The supporting assembly 20 further includes a third connecting rod 28. One end of the third connecting rod 28 is connected to the third rotating portion 27, and the other end of the third connecting rod 28 is connected to the canopy 10 to control the rotation of the third connecting rod 28 by controlling the rotation of the third rotating portion 27, thereby performing a further adjustment to the canopy 10.

In the umbrella provided by the embodiment of the present disclosure, the photographing assembly 40 may take a photograph of the user's head(s) and send it to the control assembly 50. The control assembly 50 generates an angle adjustment signal according to the photograph of the user's head(s), and the control assembly 50 may control the driving mechanism 30 to drive the third rotating portion 27 to perform the adjustment according to the angle adjustment signal, thereby adjusting the angle through the third rotating portion, so that the umbrella may protect the user to the utmost extent.

For example, as shown in FIG. 2, when the user use his(her) right hand to hold the umbrella, the photographing assembly 40 takes a photograph of the user's head(s), and generates a position adjustment signal and an angle adjustment signal according to the photograph of the user's head(s). The control assembly 50 controls the driving mechanism 30 to drive a rotation of the first rotating portion 22 according to the position adjustment signal, so as to rotate the telescopic mechanical shaft 25 and other components connected to the other end thereof to the user's head(s) side, and then the driving mechanism 30 drives the telescopic mechanical shaft 25 to be retracted or extended and drives the second rotating portion 23 to rotate, such that the center of the canopy 10 is located just over the top of the user's head(s). The control assembly 50 in turn controls the third rotating portion 27 to rotate according to the angle adjustment signal so as to perform an adjustment to the angel of the canopy 10, thereby protecting the user to the utmost extent.

In some embodiments, the driving mechanism 30 may be one or more stepping motors. The first rotating portion 22, the second rotating portion 23, the third rotating portion 27, and the telescopic mechanical shaft 25 may be driven by a plurality of stepping motors, respectively. It is also possible that the first rotating portion 22, the telescopic mechanical shaft 25, the second rotating portion 23, and the third rotating portion 27 are sequentially driven by a stepping motor.

Figure 3:
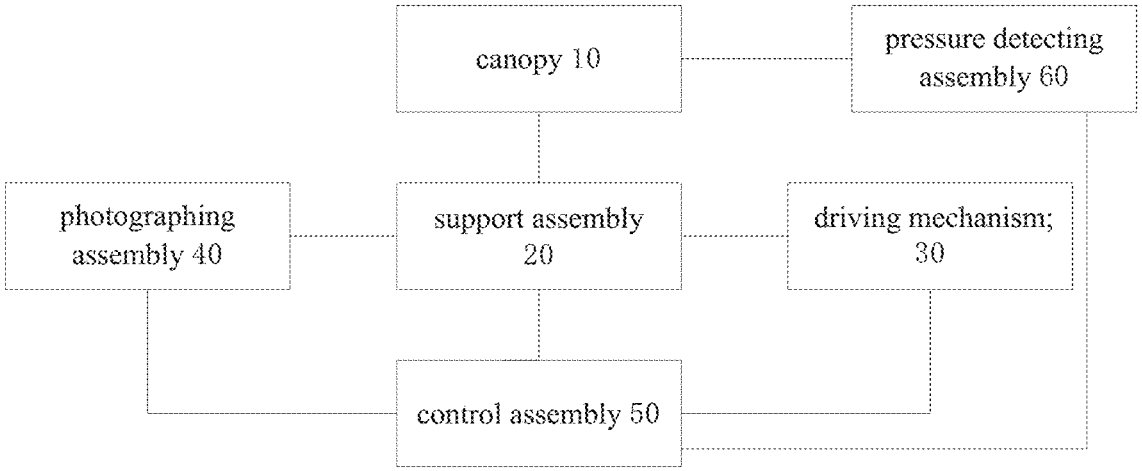
FIG. 3 is a block schematic diagram of an umbrella according to some embodiments of the present disclosure.

According to some embodiments of the present disclosure, as shown in FIG. 3, the umbrella further includes a pressure detecting assembly 60.

The pressure detecting assembly 60 is disposed corresponding to the canopy 10, and the pressure detecting assembly 60 is connected to the control assembly 50, the pressure detecting assembly 60 is configured to detect force distribution information of the canopy 10, and the control assembly 50 is used for generating an angle adjustment signal according to the force distribution information of the canopy 10, and drives and controls the second rotating portion 23 through the driving mechanism 30 in accordance with the angle adjustment signal.

In some embodiments, the pressure detecting assembly 60 may include a plurality of pressure sensors that may be distributed in an array on the canopy 10.

The umbrella provided by the embodiment of the present disclosure may also adjust the second rotating portion 23 according to pressures applied thereon. The pressure detecting assembly 60 detects the pressures in various direction of the canopy 10, and generates a pressure signal and sends it to the control assembly 50. The control assembly 50 controls the driving mechanism to drive the second rotating portion 23 to rotate according to the pressure. During a process of shielding from rain with the umbrella adopted by the user, the pressure detecting assembly 60 disposed corresponding to the canopy 10 may detect the pressures at various locations across the canopy 10, so that the control assembly 50 may determine the direction of the rain according to the pressures at various locations across the canopy 10. And the control unit 50 in turn drives and controls the second rotating portion 23 by the driving mechanism 30 so that the canopy 10 may be adapted to the direction of the rain, thereby maximally protecting the user.

In some embodiments, the umbrella is also capable of angularly adjusting the third rotating portion 27 according to the pressures, that is, the control assembly 50 controls the driving mechanism 30 to drive the third rotating member 27 to rotate according to the pressure signal to adjust the angle of the canopy 10.

According to some embodiments of the present disclosure, the user information includes the number of the users and the location of the user.

For example, when the user comprises a single person, the control assembly 50 generates a position adjustment signal according to the distance between the position of the user and the center position of the canopy 10, and controls the driving mechanism 30 to drive the support assembly 20 according to the position adjustment signal such that the coverage of the canopy 10 includes the location of the user.

In some embodiments, the coverage of the canopy 10 includes the location of the user, including the projected area of the canopy on the ground including the projected area of the user on the ground.

In some embodiments, the coverage of the canopy 10 includes the position of the user, including the center position of the canopy facing immediately over the center of the user's head(s).

For example, when the user comprises a plurality of people, the control assembly 50 generates a position adjustment signal according to the distance between the position of each user and the center position of the canopy 10, and controls the driving mechanism 30 to drive the support assembly 20 according to the position adjustment signal. The coverage of the canopy 10 includes a central location among a plurality of the users.

In some embodiments, the coverage of the canopy 10 includes a central location among a plurality of the users, including the projected area of the canopy 10 on the ground including the central location of the projection areas of the users on the ground.

In some embodiments, the coverage of the canopy 10 includes a central location of a plurality of the users, including a central location of the canopy 10 facing immediately over a central location of a plurality of the users.

The umbrella of the embodiment of the present disclosure may be a single person or a plurality of people. When the photograph of the head(s) of the user photographed by the photographing assembly 40 is a photograph of a head of a single person, the control assembly 50 determines the user to be a single person, and generates a position adjustment signal according to the distance between the position of the user and the center position of the canopy 10, and in turn controls the driving mechanism 30 according to the position adjustment signal to drive the support assembly 20; when the photograph of the head(s) of the user photographed by the photographing unit 40 is a photograph of a head of a plurality of people, the control unit 50 determines the user to be a plurality of people, and generates a distance adjustment signal according to various distances between a position of each user and the central position of the canopy 10, and then the driving mechanism 30 is driven to drive the support assembly 20 according to the position adjustment signal, so that the center position of the canopy may face immediately above the user's central position in the case of single person, or the users' central position in case of multiple persons.

For example, when the user comprises two people, the user's head picture taken by the photographing assembly 40 is a photograph of a head of a double, and the control assembly 50 determines the user to be a double; and generates a position adjustment signal, according to a distance between a center point between the positions of the two user's head positions and the central position of the canopy 10, so as to in turn control the umbrella.

According to some embodiments of the present disclosure, the photographing assembly 40 may be disposed at the second rotating portion 23 to facilitate photographing a user's head picture. The photographing assembly 40 may take a photograph of the user's head in real time, and adjust the position of the canopy 10 in real time.

The umbrella provided by the embodiment of the present disclosure supports the canopy through the support assembly, the driving mechanism drives the support assembly, the photographing assembly takes a photograph of the user's head(s), and the control assembly acquires the user information according to the photograph of the user's head(s); and the user information is processed to generate an adjustment signal, and the driving mechanism is controlled in accordance with the adjustment signal to adjust the coverage of the canopy. Therefore, the umbrella of the embodiment of the present disclosure may adjust the coverage of the canopy according to the photograph of the user's head(s), so that the coverage of the umbrella covers the top of the user's head, thereby maximally protecting the user and fully utilizing the umbrella to cover the rain.

Figure 5:
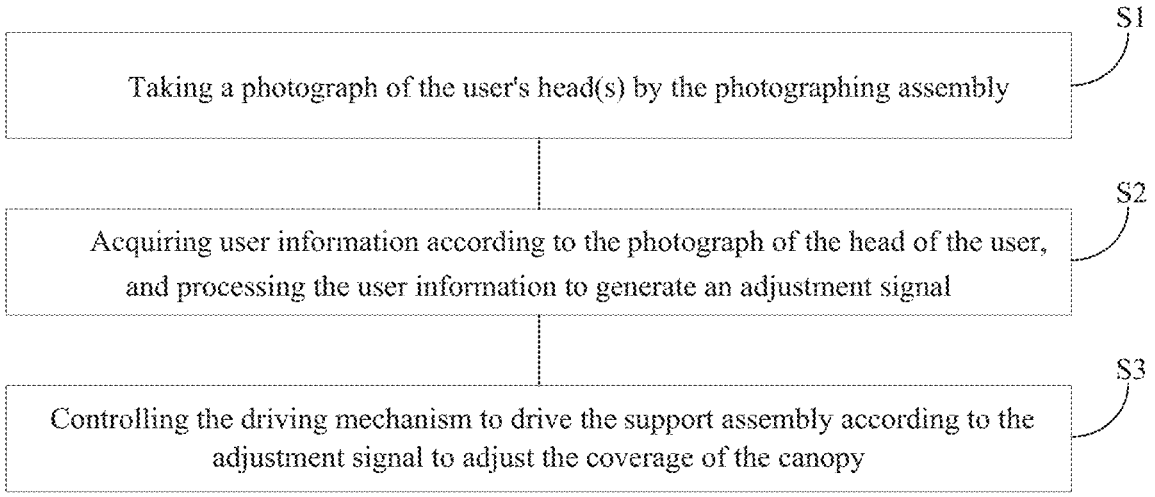
FIG. 5 is a flow chart of a method for controlling an umbrella in accordance with some embodiments of the present disclosure.

FIG. 5 is a method for controlling an umbrella according to an embodiment of the present disclosure. As shown in FIG. 5, the method for controlling an umbrella according to an embodiment of the present disclosure includes the following steps:

S1: Taking a photograph of the user's head(s) by the photographing assembly.

S2: Acquiring user information according to the photograph of the head of the user, and processing the user information to generate an adjustment signal.

S3: Controlling the driving mechanism to drive the support assembly according to the adjustment signal to adjust the coverage of the canopy.

The photographing assembly takes a photograph of the user's head(s), the user information is obtained according to the photograph of the user's head, and the user information is processed to generate an adjustment signal, and the driving mechanism is controlled to drive the support assembly according to the adjustment signal, so as to adjust the coverage of the canopy so that the umbrella may protect the user to the utmost extent.

According to some embodiments of the present disclosure, the support assembly includes a hand-held portion, a first rotating portion and a second rotating portion. The first rotating portion is connected to the hand-held portion through a first connecting rod, and the second rotating portion is connected to the first rotating portion through a telescopic mechanical shaft and is connected to the canopy through a second connecting rod. The driving mechanism drives the supporting assembly, including: the driving mechanism adjusting the position of the canopy by driving the first rotating portion and the telescopic mechanical shaft, and performing a first adjustment to the angle of the canopy by driving the second rotating portion.

The rotation angle of the first rotating portion in a plane perpendicular to the first connecting rod ranges between 0-360 degrees, and the second rotating portion is used for controlling the deflection of the second connecting rod with respect to the vertical direction, at the deflection angle ranging between 0-90 degrees. Specifically, the first rotating portion is configured to control the telescopic mechanical shaft to rotate in a plane perpendicular to the first connecting rod, at the angle ranging between 0-360 degrees. The second rotating portion is configured to control the second connecting rod to be deflected with respect to the direction parallel to the first connecting rod, that is, as shown in FIG. 2, to be rotated from the vertical direction to the horizontal direction, at the angle ranging between 0-90 degrees.

In some embodiments, the support assembly is connected to the canopy sequentially through the hand-held portion, the first connecting rod, the first rotating portion, the telescopic mechanical shaft, the second rotating portion and the second connecting rod, and the first connecting rod is perpendicular to the telescopic mechanical shafts.

In the umbrella provided by the embodiment of the present disclosure, the photographing assembly may take a photograph of the user's head(s), and generate a position adjustment signal according to the photograph of the user's head(s), and then control the driving mechanism to drive the first rotating portion, the second rotating portion and a telescopic mechanical shaft according to the position adjustment signal. When the umbrella is held by the user through the hand-held portion, the first rotating portion is driven to rotate by the driving mechanism according to the position adjustment signal, and the first rotating portion may in turn rotate the telescopic mechanical shaft, the second rotating portion, the second connecting rod in a plane perpendicular to the first connecting rod when the first rotating portion is rotated, so that the canopy 10 may be maintained over the top area of the user regardless the user holds the umbrella with the left hand or the right hand. The driving mechanism further drives the telescopic mechanical shaft to be telescoped or stretched, so that the second rotating portion may be maintained over the head(s) of the user. After the positions of the first rotating portion and the telescopic mechanical shaft are determined, the driving mechanism drives the second rotating portion to rotate, and the second rotating portion may be rotated between the vertical direction and the horizontal direction to adapt to the user's posture. For example, when the user leans forward, the second rotating portion may rotate at the angle at which the user leans, so that the umbrella may be maintained over the head(s) of the user regardless the user adopts any postures, to protect the user to the utmost extent.

According to some embodiments of the present disclosure, the support assembly further includes a third rotating portion and a third connecting rod. The third rotating portion is connected between the second connecting rod and the third connecting rod and the third connecting rod is connected between the canopy and the third rotating portion. The driving mechanism further drives the third rotating portion to adjust the angle of the canopy according to the angle adjustment signal. The third rotating portion is used for controlling the third connecting rod to be deflected with respect to the vertical direction, at the deflection angle ranging between 0-20 degrees.

In the umbrella of the embodiment of the present disclosure, one end of the second connecting rod is connected to the second rotating portion, and the other end of the second connecting rod is connected to the third rotating portion. The supporting assembly further includes a third connecting rod, one end of the third connecting rod is connected to the third rotating portion, and the other end of the third connecting rod is connected to the canopy to control the rotation of the third connecting rod by controlling the rotation of the third rotating portion, thereby adjusting the canopy.

In other words, the photographing assembly may take a photograph of the user's head(s), and generate an angle adjustment signal according to the photograph of the user's head(s), and further control the driving mechanism to drive the third rotating unit to perform adjustment according to the angle adjustment signal. The angle is then adjusted by the third rotating portion, so that the umbrella may protect the user to the utmost extent.

For example, as shown in FIG. 2, when the umbrella is held by the user with the right hand, the photographing assembly takes a photograph of the user's head(s), generates a position adjustment signal and an angle adjustment signal according to the photograph of the user's head(s), and controls the driving mechanism to drive the first rotating portion to rotate according to the position adjustment signal, so as to rotate the telescopic mechanical shaft and other components connected to the other end thereof to the user's head side, and then the driving mechanism drives the telescopic mechanical shaft to be telescoped or stretched and drives the second rotating portion to rotate, so that the center of the canopy is over the top of the user's head, and then control the rotation of the third rotating portion according to the angle adjustment signal to adjust the angle of the canopy to protect the user to the utmost extent.

According to some embodiments of the present disclosure, the method for controlling an umbrella further includes: detecting force distribution information of the canopy; generating an angle adjustment signal according to the force distribution information of the canopy, and driving and controlling the second rotating portion with the driving mechanism according to the angle adjustment signal.

It should be noted that the force distribution information of the canopy may be detected by the pressure detecting assembly. The pressure detecting assembly may include a plurality of pressure sensors, and the plurality of pressure sensors may be distributed in an array across the canopy.

That is to say, the umbrella may also adjust the second rotating portion according to the pressure. When the umbrella is used by the user to keep out the rain, the pressure detecting assembly may detect the pressures at various positions of the canopy, so that the direction of the rain may be determined according to the pressures at various positions of the canopy, and then the second rotating portion is driven and controlled by the driving mechanism, so as to adapt the canopy to the direction of the rain, and the user may be protected to the utmost extent.

It should be understood that the umbrella may also adjust the angle of the third rotating portion according to the pressures, that is, control the driving mechanism to drive the rotation of the third rotating portion according to the pressure signal, so as to adjust the angle of the canopy.

According to some embodiments of the present disclosure, the user information includes the number of the users and the position(s) of the user, when the user comprises a single person, a position adjustment signal is generated according to the distance between the position of the user and the center position of the canopy. The driving mechanism is controlled to drive the support assembly according to the position adjustment signal, so that the coverage of the canopy covers the position of the user; when the user comprises a plurality of persons, a position adjustment signal is generated according to the position of each of the user and the center position of the canopy, and the driving mechanism is controlled to drive the support assembly according to the position adjustment signal such that the coverage of the canopy covers a central position among the plurality of the persons of the users.

That is to say, the user of the umbrella may comprise a single person or a plurality of persons. When the photograph of the user's head(s) taken by the photographing assembly comprises a photograph of a head of a single person, it is determined that the user comprises a single person, and a position adjustment signal is generated according to the distance between the user's position and the center position of the canopy, and the driving mechanism is controlled to drive the support assembly according to the position adjustment signal. When the photograph of the user's head(s) taken by the photographing assembly comprises a photograph of heads of a plurality of persons, it is determined that the user comprises a plurality of persons, and a position adjustment signal is generated according to the distance between the position of each person of the user and the center position of the canopy, and the driving mechanism is controlled to drive the support assembly according to the position adjustment signal, such that the coverage of the canopy may include the user's central position regardless in the case of a single person or a plurality of persons.

According to some embodiments of the present disclosure, the photographing assembly may be disposed at the second rotating portion to facilitate taking a photograph of the user's head(s). The photographing assembly may take a photograph of the user's head(s) in real time, and adjust the position of the canopy in real time.

Figure 6:
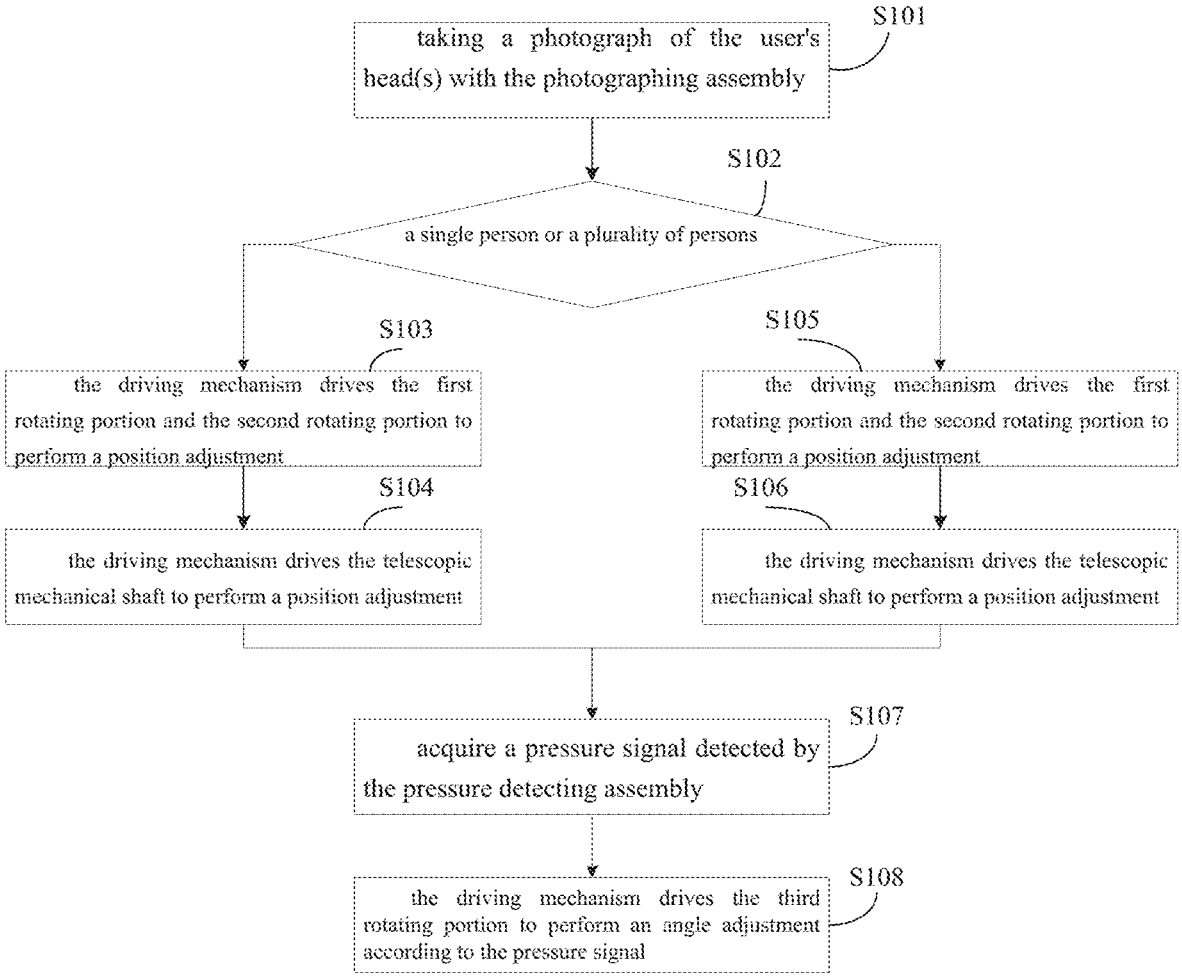
FIG. 6 is a flow chart of a method for controlling an umbrella in accordance with some embodiments of the present disclosure.

According to a specific embodiment of the present disclosure, as shown in FIG. 6, the method for controlling an umbrella according to an embodiment of the present disclosure includes the following steps:

S101: taking a photograph of the user's head(s) with the photographing assembly.

S102: determining whether the user comprises a single person or a plurality of persons.

If the user comprises a single person, step S103 is performed; if the user comprises a plurality of persons, step S105 is performed.

S103: the driving mechanism drives the first rotating portion and the second rotating portion to perform a position adjustment.

S104: the driving mechanism drives the telescopic mechanical shaft to perform a position adjustment, and step S107 is performed.

S105: the driving mechanism drives the first rotating portion and the second rotating portion to perform a position adjustment.

S106: the driving mechanism drives the telescopic mechanical shaft to perform a position adjustment.

S107: acquire a pressure signal detected by the pressure detecting assembly.

S108: the driving mechanism drives the third rotating portion to perform an angle adjustment according to the pressure signal.

In summary, an umbrella according to an embodiment of the present disclosure takes a photograph of the user's head(s) through a photographing assembly, and then acquires user information according to the photograph of the head(s) of the user, and processes the user information to generate an adjustment signal, and the driving mechanism is controlled to drive the support assembly according to the adjustment signal to adjust the coverage of the canopy. Therefore, the method for controlling the umbrella according to the embodiment of the present disclosure may adjust the coverage of the canopy according to the photograph of the head(s) of the user, thereby enabling the umbrella to protect the user to the utmost extent, and fully utilizing the umbrella to keep out the rain.

In the description of the present disclosure, it is to be understood that the terms "center", "upper", "lower", "front", "back", "left", "right", "vertical", "horizontal", "top", "bottom", "inner", "outer", "axial" and the like denote the orientation or positional relationship based on the orientation or positional relationship shown in the drawings, which is merely for convenience of description to the present disclosure and simplifying the description and which is not indicated or implied that the device or the component of the invention may necessarily have a particular orientation, and is constructed and operated in a particular orientation, and thus which is not to be construed as limiting.

Moreover, the terms "first", "second" and "third" are used for descriptive purposes only, and are not to be construed as indicating or implying a relative importance or implicitly indicating the number of technical features indicated. Thus, features defining "first," "second," and "third," may include explicitly or implicitly at least one of the features. In the description of the present disclosure, the meaning of "a plurality" is at least two, such as two, three, unless specifically defined otherwise.

In the present disclosure, unless otherwise specifically defined and defined, the terms "connected", "connecting" and the like are to be understood broadly, and may be, for example, a fixed connection, a detachable connection, or an integral. The connection may be a mechanical connection, and may also be an electrical connection; it may be directly connected, or may be indirectly connected through an intermediate medium, and may be an internal communication between two elements or an interaction relationship of two elements unless explicitly defined otherwise. For those skilled in the art, the specific meanings of the above terms in the present disclosure may be understood on a case-by-case basis.

In the present disclosure, the first feature "on" or "under" the second feature may be a direct contact of the first and second features, or the first and second features may be indirectly contacted through an intermediate medium, unless otherwise explicitly stated and defined. Moreover, the first feature "over", "above" and "on" the second feature may be that the first feature is directly above or obliquely above the second feature, or merely that a level of the first feature is higher than that of the second feature. The first feature "below", and "under" the second feature may be that the first feature is directly below or obliquely below the second feature, or merely that a level of the first feature is lower than that of the second feature.

In the description of the present specification, the description with reference to the terms "one embodiment", "some embodiments", "example", "specific example", or "some examples" and the like means a specific feature described in connection with the embodiment or example. A structure, material, or feature is included in at least one embodiment or example of the present disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, various embodiments or examples described in the specification, as well as features of various embodiments or examples, may be combined by those skilled in the art.

While the embodiments of the present disclosure have been shown and described above, it is understood that the above-described embodiments are illustrative and are not to be construed as limiting the scope of the disclosure. Those skilled in the art may make variations, modifications and substitutions to the embodiments.

What is claimed is:

1. An umbrella, comprising:

a canopy;

a support assembly configured to support the canopy;

a driving mechanism configured to drive the support assembly;

a photographing assembly configured to take a photograph of user's head(s) and output the photograph of user's head(s); and a control assembly configured to acquire a user information according to an outputted photograph of user's head(s), and to process the user information to generate an adjustment signal, and to control the driving mechanism according to the adjustment signal, so as to adjust a coverage of the canopy, wherein the support assembly comprises:

a hand-held portion;

a first rotating portion connected to the hand-held portion through a first connecting rod; and a second rotating portion connected to the first rotating portion through a telescopic mechanical shaft and connected to the canopy through a second connecting rod, wherein the driving mechanism adjusts the position of the canopy by driving the first rotating portion and the telescopic mechanical shaft, and performs a first adjustment to the angle of the canopy by driving the second rotating portion.

2. The umbrella of claim 1, wherein the user information comprises a number of the user and position(s) of the user, wherein the user comprises a single person, and the control assembly is configured to generate a position adjustment signal according to a distance between the position of the user and a center position of the canopy, and control the driving mechanism to drive the support assembly according to the position adjustment signal, such that the position of the user is within the coverage of the canopy.

3. The umbrella of claim 1, wherein the user information comprises a number of the user and position(s) of the user, wherein the user comprises a plurality of persons, and the control assembly is configured to generate a position adjustment signal according to distances each between the position of each of persons of the user and a center position of the canopy, and control the driving mechanism to drive the support assembly according to the position adjustment signal, such that a central position of the plurality of persons of the user is within the coverage of the canopy.

4. The umbrella of claim 1, wherein the support assembly further comprises a third rotating portion and a third connecting rod, the third rotating portion being connected between the second connecting rod and the third connecting rod, and the third connecting rod being connected between the canopy and the third rotating portion, wherein the driving mechanism is further configured to drive the third rotating portion according to the angle adjustment signal so as to perform a second adjustment to the angle of the canopy.

5. The umbrella of claim 4, wherein the first rotating portion is configured to control the telescopic mechanical shaft to rotate in a plane perpendicular to the first connecting rod, at a rotation angle ranging between 0-360 degrees; the second rotating portion is configured to control the second connecting rod to be deflected with respect to a vertical direction, at a deflection angle ranging between 0-90 degrees; and the third rotating portion is configured to control the third connecting rod to be deflected with respect to the vertical direction, at the deflection angle ranging between 0-20 degrees.

6. The umbrella of claim 1, further comprising a pressure detecting assembly disposed corresponding to the canopy and connected to the control assembly, wherein the pressure detecting assembly is configured to detect force distribution information of the canopy, and the control assembly is configured to generate an angle adjustment signal according to the force distribution information of the canopy and to drive the second rotating portion through the driving mechanism according to the angle adjustment signal.

7. The umbrella of claim 6, wherein the pressure detecting assembly comprises a plurality of pressure sensors distributed across the canopy.

8. The umbrella of claim 7, wherein the plurality of pressure sensors are distributed in an array.

9. The umbrella of claim 1, wherein the first connecting rod and the telescopic mechanical shaft are at an angle of 90 degrees and the telescopic mechanical shaft is extendable and retractable in an axial direction.

10. A method for controlling the umbrella of claim 1, comprising the steps of:

taking a photograph of the user's head(s) with the photographing assembly;

acquiring a user information according to the photograph of the user's head(s), and processing the user information to generate an adjustment signal; and controlling the driving mechanism to drive the support assembly according to the adjustment signal, so as to adjust the coverage of the canopy, wherein the support assembly comprises a hand-held portion, a first rotating portion and a second rotating portion, the first rotating portion being connected to the hand-held portion through a first connecting rod and the second rotating portion being connected to the first rotating portion through a telescopic mechanical shaft and being connected to the canopy through a second connecting rod, wherein the driving mechanism driving the support assembly, comprising:

the driving mechanism adjusting a position of the canopy by driving the first rotating portion and the telescopic mechanical shaft, and adjusting an angle of the canopy by driving the second rotating portion.

11. The method of claim 10, further comprising:

detecting force distribution information of the canopy; and generating an angle adjustment signal according to the force distribution information of the canopy, and driving and controlling the second rotating portion with the driving mechanism according to the angle adjustment signal.

12. The method of claim 11, wherein the support assembly further comprises a third rotating portion and a third connecting rod, the third rotating portion being connected between the second connecting rod and the third connecting rod, and the third connecting rod being connected between the canopy and the third rotating portion, wherein the driving mechanism further drives the third rotating portion according to the angle adjustment signal to adjust the angle of the canopy.

13. The method of claim 12, wherein the first rotating portion is configured to control the telescopic mechanical shaft to rotate in a plane perpendicular to the first connecting rod, at a rotation angle ranging between 0-360 degrees; the second rotating portion is configured to control the second connecting rod to be deflected with respect to a vertical direction, at a deflection angle ranging between 0-90 degrees; and the third rotating portion is configured to control the third connecting rod to be deflected with respect to the vertical direction, at the deflection angle ranging between 0-20 degrees.

14. The method of claim 10, wherein the user information comprises a number of the user and the position(s) of the user, wherein in response to the user comprising a single person, a position adjustment signal is generated according to a distance between the position of the user and a center position of the canopy, and the driving mechanism is controlled to drive the support assembly according to the position adjustment signal, such that the position of the user falls within the coverage of the canopy.

15. The method of claim 10, wherein the user information comprises a number of the user and the position(s) of the user, wherein in response to the user comprising a plurality of persons, a position adjustment signal is generated according to a distance between the position of each of persons of the user and a center position of the canopy, and the driving mechanism is controlled to drive the support assembly according to the position adjustment signal, such that a central position among the plurality of persons of the user falls within the coverage of the canopy.

* * * * *